US009555472B2

(12) United States Patent
Soinila et al.

(10) Patent No.: US 9,555,472 B2
(45) Date of Patent: Jan. 31, 2017

(54) ARC MELTING AND TILT CASTING APPARATUS

(75) Inventors: Erno Soinila, Vantaa (FI); Tuomas Pihlajamaki, Espoo (FI); Sven Bossuyt, Helsinki (FI); Hannu Hanninen, Helsinki (FI)

(73) Assignee: Aalto University Foundation, Helsinki (FI)

( * ) Notice: Subject to any disclaimer, the term of this patent is extended or adjusted under 35 U.S.C. 154(b) by 0 days.

(21) Appl. No.: 14/122,664

(22) PCT Filed: May 11, 2012

(86) PCT No.: PCT/FI2012/050458

§ 371 (c)(1),
(2), (4) Date: Feb. 19, 2014

(87) PCT Pub. No.: WO2012/164152

PCT Pub. Date: Dec. 6, 2012

(65) Prior Publication Data

US 2014/0209267 A1 Jul. 31, 2014

(30) Foreign Application Priority Data

May 27, 2011 (FI) ..... 20115527

(51) Int. Cl.
*B22D 23/00* (2006.01)
*B22D 41/01* (2006.01)
(Continued)

(52) U.S. Cl.
CPC ..... *B22D 47/00* (2013.01); *B22D 23/006* (2013.01); *B22D 41/01* (2013.01); *C22B 9/20* (2013.01);
(Continued)

(58) Field of Classification Search
CPC ..... B22D 23/006; B22D 41/04; B22D 41/06; B22D 39/00; C22B 9/20
(Continued)

(56) References Cited

U.S. PATENT DOCUMENTS 2,125,080 A 7/1938 Merrick
3,977,462 A 8/1976 Ohara
(Continued)

FOREIGN PATENT DOCUMENTS

CN 101199991 A 6/2008
CN 101816915 A * 9/2010
(Continued)

OTHER PUBLICATIONS

Soinila et al., Bulk metallic glass tube casting, Journal of Alloys and Compounds, pp. S210-S213, Dec. 28, 2010.*
(Continued)

*Primary Examiner* — Kevin E Yoon
(74) *Attorney, Agent, or Firm* — Chernoff, Vilhauer, McClung & Stenzel, LLP

(57) ABSTRACT

An arc melting and tilt casting apparatus having a casing provided with a vacuum chamber for housing a hearth having a melting trough and pouring means, arc-melting electrode means passing through the casing in the chamber, a mold having a melt receiving orifice, vacuum generating means, sealing means for maintaining the vacuum in the chamber and tilting means for tilting the apparatus to cause the melt to flow from the melting trough via the pouring means in the mold through the mold orifice. The hearth and mold are connected together and moveable as a single unit in the vacuum chamber and out from the chamber.

6 Claims, 1 Drawing Sheet

(51) Int. Cl.

| | |
|---|---|
| ***B22D 47/00*** | (2006.01) |
| ***C22B 9/20*** | (2006.01) |
| ***C22C 1/00*** | (2006.01) |
| ***C22C 45/00*** | (2006.01) |
| ***F27B 3/08*** | (2006.01) |
| ***F27B 3/06*** | (2006.01) |
| ***F27B 17/00*** | (2006.01) |
| ***F27D 7/06*** | (2006.01) |
| ***F27D 11/08*** | (2006.01) |

(52) U.S. Cl.
CPC ..... *C22C 1/00* (2013.01); *C22C 1/002* (2013.01); *C22C 45/00* (2013.01); *F27B 3/065* (2013.01); *F27B 3/085* (2013.01); *F27B 17/0016* (2013.01); *F27D 7/06* (2013.01); *F27D 11/08* (2013.01)

(58) Field of Classification Search
USPC ..... 164/136, 336, 335, 495, 514
See application file for complete search history.

(56) References Cited

U.S. PATENT DOCUMENTS 5,168,917 A 12/1992 Okuda et al.
5,634,514 A * 6/1997 Gagliano ..... 164/495

FOREIGN PATENT DOCUMENTS

| | | | |
|---|---|---|---|
| DE | 3521086 | A1 | 12/1986 |
| DE | 10 2006 058 142 | A1 | 6/2008 |
| EP | 0 951 959 | A1 | 10/1999 |
| EP | 0 967 035 | A1 | 12/1999 |
| GB | 1135454 | A | 12/1968 |
| GB | 1211945 | | 11/1970 |
| JP | 53-60395 | | 5/1978 |
| JP | 6292962 | A | 10/1994 |
| JP | 2003-290909 | A | 10/2003 |
| JP | 2003290909 | A | 10/2003 |
| JP | 2009-68101 | A | 4/2009 |
| JP | 2009068101 | A | 4/2009 |

OTHER PUBLICATIONS

International Search Report, PCT International App. No. PCT/FI2012/050458, filed May 11, 2012, Aalto University Foundation, 4 pgs.

* cited by examiner

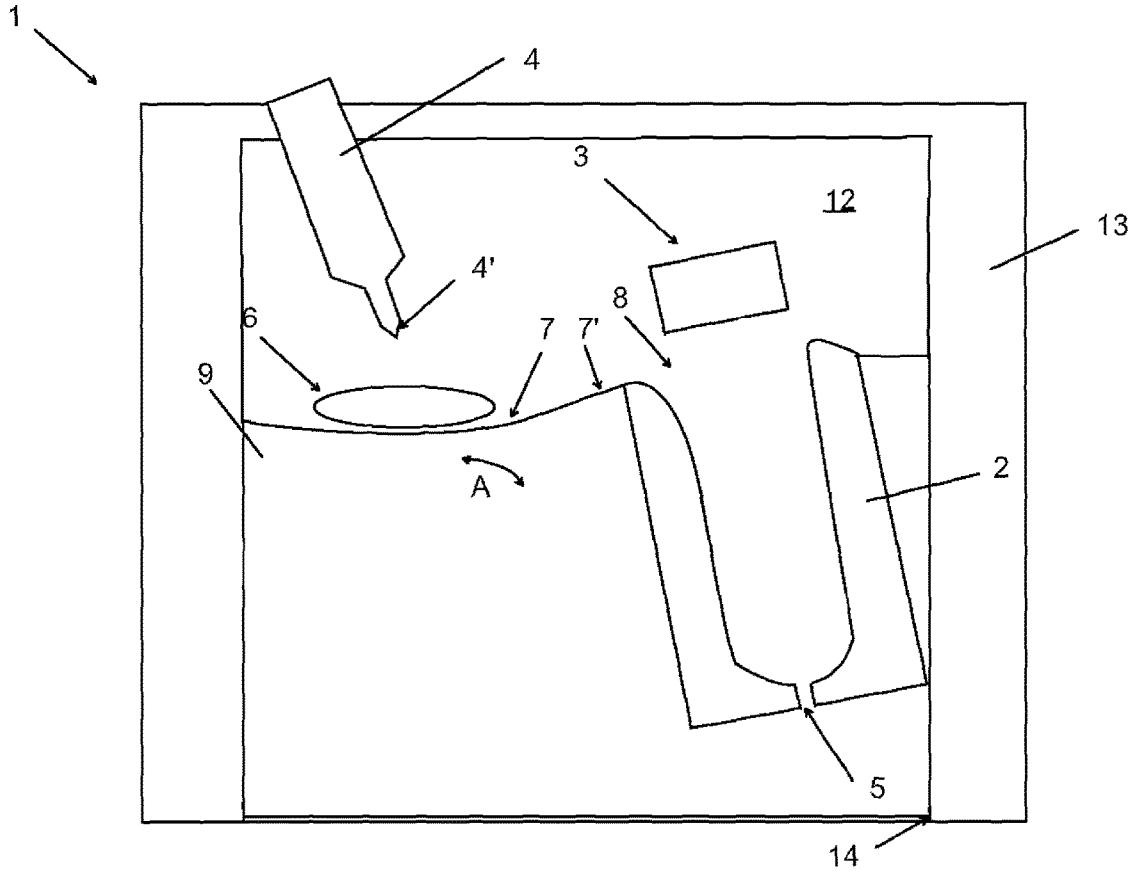
1
4
3
12
13
4'
8
6
7
7'
9
A
2
5
14

ARC MELTING AND TILT CASTING APPARATUS

CROSS-REFERENCE TO RELATED APPLICATION

This is a national stage application filed under 35 USC 371 based on International Application No. PCT/FI2012/050458, filed Nov. 5, 2012, which claims priority to Finnish Application No. 2011552, filed May 27, 2011.

BACKGROUND OF THE INVENTION

The present invention is related to a combined arc melting and tilt casting apparatus used, e.g. for the manufacture of bulk metallic glass materials.

Tilt casting is reported to produce the best fatigue endurance in Zr-based bulk metallic glasses. Incorporating the alloying and casting facilities in a single piece of equipment reduces the amount of laboratory space and capital investment needed. Eliminating the sample transfer step from the production process also saves time and reduces sample contamination. The glass forming ability in many alloy systems, such as Zr-based glass-forming alloys, deteriorates rapidly with increasing oxygen content of the specimen.

Bulk metallic glasses are amorphous metals, with a diameter larger than 1 mm, that solidified without detectable crystallization. Upon heating from the solid state these alloys exhibit a glass transition, after which they remain metastable for a finite length of time in the super-cooled liquid region, before crystallizing. Enhanced stability against crystallization is usually achieved by alloying multiple elements with significant difference (>12%) in atomic radius and negative heats of mixing among constituent elements. The critical casting diameters of known BMG alloys typically range from 1 mm to 100 mm. BMG alloys have been found in many different alloy groups (Pd-, Mg-, Ln-, Zr-, Ti-, Fe-, Co-, Ni- and Cu-based systems) and new alloys have been discovered and reported with a variety of different properties. By casting BMG alloys, without cold working or heat treatment, complex shapes can be produced with excellent mechanical properties: purely plastic deformation up to a yield strain of typically 2%, resulting in tensile strength from 1500 MPa to 5500 MPa, with Youngs modulus from 70 MPa to 275 MPa. The lack of grain boundaries in the BMG materials also results in very accurate surface finish and enhances corrosion resistance. Several recent reviews testify to the widespread interest in these materials both from a fundamental science perspective and for practical applications.

Different methods may be used to produce amorphous metals, each with its own advantages and disadvantages, whose relative importance depends on the alloy composition and the intended purpose. Strictly speaking, an amorphous solid is called a glass only if it was formed when a liquid state underwent a glass transition. Thus, metallic glasses are formed by melting the constituents to obtain a molten alloy with the desired composition, and then quenching the molten alloy below its glass transition temperature. Often, pre-alloying to obtain the desired composition and quenching to the glassy state are entirely separate processes, carried out in different apparatuses. Prior to the discovery of bulk glass-forming alloy compositions, the rapid quenching methods required to avoid crystallization for most metallic glass-formers meant that these materials could be produced in glassy form only as thin ribbons, foils or wires. The significance of BMGs can be attributed in large part to the versatility of metal mold casting methods in producing different shapes, as well as larger objects, out of metallic glass. If needed, casting can be followed by additional shaping or patterning steps—involving machining operations or superplastic forming in the viscous super-cooled liquid region—but usually the pre-alloying and casting steps are decisive for the quality of the final part.

For alloying, induction melting and arc melting under inert atmosphere arc commonly used, both with water-cooled copper crucibles. Both methods allow precise control of the melting process in laboratory scale production. Typically, the process chamber is repeatedly evacuated to a pressure below $1\times10^{-3}$ Pa and backfilled with purified argon, then purged of any remaining oxygen by titanium gettering before the constituent metals are melted for alloying. It is standard practice to flip over the pre-alloyed ingot and remelt it several times to ensure that its composition is uniform. When the process chamber must be opened to air to flip the ingot, renewing the inert atmosphere takes time, wastes argon, and risks contaminating the BMG with oxygen. Oxygen is harmful for BMG manufacture because, for some of the phases whose crystallization competes with glass formation, the crystallization kinetics are enhanced by oxygen. As a result, BMG samples contaminated with oxygen typically are inferior to high-purity samples. So not only is it quicker and more economical to perform the necessary manipulation of the ingot without repeatedly opening the process chamber: it also produces better samples.

For casting BMG, variants of metal mold casting are most commonly used. The method of quenching described in the earliest reports of bulk metallic glass formation in the Pd—Ni—P system—and earlier work on marginally bulk glass forming Pd—Si based alloys—did not involve metal mold casting. For some alloys, direct quenching of remelted pre-alloyed ingots in a fused silica container, especially in combination with fluxing, is still the preferred method for making high-quality BMG samples. However, it is difficult to produce complex shapes by this method, and the dimensional tolerances and surface quality obtained by direct quenching methods are not as good as those obtained by metal mold casting. A relatively simple version of metal mold casting consists of induction melting an pre-alloyed ingot in a fused silica crucible that has an orifice at the bottom, and then applying gas pressure to eject the molten BMG forming alloy into a mold placed beneath the crucible. High vacuum induction melting and argon pressure casting apparatus, with a linear feedthrough for moving the fused quartz crucible from the induction coil to the mold orifice, was found to be very versatile in easily producing different specimen shapes, such as bars, rods, wedges, rings, bar, and "dogbone" tensile specimen. In a laboratory setting—where process conditions are often varied—it is particularly convenient to be able to view the sample through the quartz crucible during melting. However, because the same quartz crucible is a possible source of oxygen contamination, it may sometimes be preferable to use other crucible materials, such as graphite. More sophisticated casting methods such as suction casting, tilt casting, squeeze casting and cap casting may produce better quality specimens, e.g., because they can more consistently and more uniformly fill the mold and achieve higher cooling rates. In particular, BMG specimens produced by the combination of tilt casting with cap casting or squeeze casting, compared to those produced by conventional tilt casting, have been reported to exhibit larger critical casting diameter and improved ductility.

BRIEF DESCRIPTION OF THE DRAWINGS

FIG. 1 shows an exemplary Arc Melting and Tilt Casting Apparatus.

DETAILED DESCRIPTION

The aim of the present invention is to create a versatile instrument, in which high purity conditions can be maintained throughout the process, even when melting alloys with high affinity for oxygen. To this end the arc melting and tilt casting apparatus having a casing provided with a vacuum chamber for housing a hearth having a melting trough and pouring means, arc-melting electrode means passing through the casing in the chamber, a mould having a melt receiving orifice, vacuum generating means, sealing means for maintaining the vacuum in the chamber and tilting means for tilting the apparatus to cause the melt to flow from the melting trough via the pouring means in the mold through the mold orifice, is characterized in that the hearth and mold are connected together and moveable as a single unit in the vacuum chamber and out from the chamber.

The design of the present invention provides a high-vacuum chamber to be filled with a low-oxygen atmosphere, and takes special care to keep the system hermetically sealed throughout the process. In particular, movements of the arc-melting electrode and sample manipulator arm are accommodated by deformable metal bellows, rather than sliding O-ring seals, and the whole furnace is tilted for tilt casting.

It is known that in high vacuum systems each feedthrough and each seal produces a measurable leak. Sliding O-ring seals, where a moving surface slides against the O-ring that provides the vacuum seal, are particularly prone to leaking. Also, when a vacuum chamber has been opened to atmosphere, it takes a long time to evacuate moisture adsorbed from the air onto the inside surfaces of the vacuum chamber 7 9. To provide the high-purity conditions desired for BMG processing, the main process chamber should therefore have as few feedthroughs and as little surface area as possible. Nevertheless, the apparatus should allow the full range of motions and manipulations needed to carry out each step of the process, preferably without opening the chamber to atmosphere.

The apparatus is equipped with a manipulator arm so that, for pre-alloying, the sample can be flipped and remelted without opening the chamber. It also has provisions for piston suction casting and cap casting for small specimens. For a wide range of alloy compositions and sample sizes, the complete process from pre-alloying to high-quality net-shape casting can be carried out in a continuous sequence using this apparatus. Furthermore, the critical feedthroughs in this apparatus feature ultra-high vacuum (UHV) construction methods, using flexible metal bellows for all moveable parts, and an all-metal gas line connects the chamber to a supply of high-purity inert gas. Thus, a high-purity atmosphere can be maintained throughout the entire processing sequence.

The invention will be described more specifically in the following with reference to the attached drawing the only FIG. 1 of which shows schematically an exemplary embodiment of the present invention. Only those features which are needed for understanding the invention have been shown in the FIG. 1 and it should be understood that the apparatus includes several other features necessary for its operation but they are obvious for one skilled in the art and, therefore, they are not considered necessary to be described here.

The apparatus 1 as shown in FIG. 1 includes a casing 13 having a high-vacuum chamber 12 therein. The arc-melting electrode 4 having, e.g. a tungsten tip 4', passes through the top side of the casing. A water-cooled hearth having a melting trough 7 and pouring means 7' is placed in the vacuum chamber. A mold 2 having a melt receiving orifice 8 is also inside the vacuum chamber 12. The apparatus includes also vacuum generating means (not shown), sealing means (not shown) for maintaining the vacuum in the chamber and tilting means (not shown) for tilting the apparatus to cause the melt 6 to flow from the melting trough 7 via the pouring means in the mold 2 through the mold orifice 8. An arrow A shows tilting of the apparatus. The improved feature of the present invention is that the hearth and mold are connected together and moveable as a single unit 9 in the vacuum chamber and out from the chamber. In the embodiment shown in FIG. 1 the unit 9 is raised from the bottom side of the apparatus through an opening 14.

As seen in FIG. 1, the unit 9 may form the hearth, with its melting trough 7 and pouring nozzle 7' on its upper surface. The unit 9 also defines a slot that opens to the upper surface of the unit 9 and extends into the unit 9. The slot holds the mold 2 such that the mold orifice 8 is oriented with respect to the melting trough 7 and nozzle 7' so as to cause a melt 5 to flow from the melting. trough 7 via the nozzle 7' and through the mold orifice 8, when the apparatus 1 is tilted.

Connection 5 for suction casting and means 3 for cap casting are also provided in the embodiment shown. These means are preferably connected to the unit 9 by connecting means (not shown) to be moved in the vacuum chamber and out from the chamber together with the unit 9.

The water-cooled copper hearth inside the chamber features a single large melting trough 7 with a pouring nozzle 7' leading to the mould orifice 8, and a smaller trough (not shown) for titanium gettering. The hearth is attached from below, to avoid any "internal leaks" from gas pockets that might otherwise he trapped between the hearth and the chamber. A standard ISO-K 200 O-ring seal (not shown) with centering ring separates the vacuum from the cooling water circulating underneath the copper hearth. Belleville spring washers (not shown) ensure that differential thermal expansion when the furnace is operated does not cause excessive decreases or increases in the clamp force maintained on the O-ring seal. To load a new charge into the furnace, the unit 9 is released from the rest of the chamber and lowered on a pneumatic lift (not shown) provided for that purpose.

An arc-melter necessarily includes a feedthrough for the arc melting electrode. The electrode is a water-cooled conductor that can carry an electrical current up to 500 A and can handle the 30 kV high-voltage arc-ignition spark. This current needs to be electrically isolated from the chamber potential at operating pressures and atmospheres to avoid damage to the chamber. Furthermore, the electrode should be moveable; with a freely moveable electrode tip, the operator can deliver the energy of the plasma arc precisely where it is needed to melt the sample. The feedthrough should allow a range of motions covering every possible position of the sample in the melting trough as well as the titanium getter. This freedom of movement is realized with a flexible edge-welded metal bellows (not shown), between the top side of the chamber and the electrical feedthrough (not shown) for the electrode. The electrical feedthrough is constructed of two fluoropolymer (PTFE) insulators clamped onto either side of a copper flange which is brazed onto the electrode rod. Standard ISO-K 100 O-ring seals and centering rings seal the vacuum side. The tungsten electrode tip 4' is secured with two screws to the brazed electrode tip assembly which seals the end of the water-cooled electrode rod.

To assist the operator with delicate movements of the electrode tip 4' and to prevent movements that would damage the hearth or the bellows, a mechanism for supporting the electrode is also necessary. The weight of the electrode rod and the atmospheric pressure when the chamber is evacuated amount to a force in excess of 800 N drawing the electrode towards the copper hearth. A mechanism (not shown) with pneumatically actuated servo control in the vertical direction carries this load.

Tilt casting requires a mechanism for pouring the melt from the crucible into the mold. Often this is done with a sliding O-ring seal, in which a rigid connector carrying cooling water for the metal crucible also allows to tilt the crucible towards the mold. In the present apparatus, the whole chamber is tilted. This eliminates a potentially troublesome sliding O-ring seal.

The invention claimed is:

1. An arc melting and tilt casting apparatus capable of being tilted, the apparatus comprising:

a casing provided with a vacuum chamber, a sample manipulator arm, and an arc-melting electrode passing through the chamber, where the vacuum chamber has a seal for selectively maintaining a vacuum in the vacuum chamber, and where the casing has an opening in a bottom portion of the casing;

a sliding unit having an upper surface, the sliding unit capable of being selectively raised and lowered through said opening, the sliding unit defining:

a hearth having a melting trough and a pouring nozzle, each formed on the upper surface of the sliding unit; and a slot opening to said upper surface and extending into said sliding unit, the slot holding a mold having a melt-receiving orifice oriented with respect to said melting trough and said nozzle so as to cause a melt to flow from the melting trough via the nozzle and through the mold orifice, when said apparatus is tilted, such that the hearth and mold are moveable as a single unit into the vacuum chamber and out from the chamber from below and through the opening in the bottom portion of the casing.

2. The apparatus of claim 1, including a piston for cap casting.

3. The apparatus of claim 2 characterized in that the piston for cap casting is connected to the unit to be moved together with the unit.

4. The apparatus of claim 2 characterized in that it further includes an aperture for suction casting.

5. The apparatus of claim 1, characterized in that it further includes an aperture for suction casting.

6. The apparatus of claim 5 characterized in that the aperture for suction casting is connected to the unit to be moved together with the unit.

* * * * *